US010036105B2

(12) United States Patent
Joo et al.

(10) Patent No.: US 10,036,105 B2
(45) Date of Patent: Jul. 31, 2018

(54) POROUS CARBON NANOFIBERS AND MANUFACTURING THEREOF

(71) Applicant: CORNELL UNIVERSITY, Ithaca, NY (US)

(72) Inventors: Yong Lak Joo, Ithaca, NY (US); Brian Williams, Ithaca, NY (US)

(73) Assignee: CORNELL UNIVERSITY, Ithaca, NY (US)

( * ) Notice: Subject to any disclaimer, the term of this patent is extended or adjusted under 35 U.S.C. 154(b) by 0 days.

(21) Appl. No.: 14/912,981

(22) PCT Filed: Aug. 21, 2014

(86) PCT No.: PCT/US2014/052068
§ 371 (c)(1),
(2) Date: Feb. 19, 2016

(87) PCT Pub. No.: WO2015/027052
PCT Pub. Date: Feb. 26, 2015

(65) Prior Publication Data

US 2016/0201227 A1 Jul. 14, 2016

Related U.S. Application Data

(60) Provisional application No. 61/868,218, filed on Aug. 21, 2013.

(51) Int. Cl.
*D01F 9/12* (2006.01)
*D01F 2/28* (2006.01)
(Continued)

(52) U.S. Cl.
CPC ..... *D01F 9/12* (2013.01); *D01D 5/003* (2013.01); *D01D 5/0007* (2013.01); *D01D 5/247* (2013.01);
(Continued)

(58) Field of Classification Search
CPC ..... D01D 5/0007; D01D 5/247; D01D 5/003; D01F 1/08; D01F 9/14; D01F 6/18;
(Continued)

(56) References Cited

U.S. PATENT DOCUMENTS

2005/0247236 A1* 11/2005 Frey ..... C08B 1/003 106/311
2005/0287239 A1* 12/2005 Joo ..... D01D 5/0023 425/382.3
(Continued)

FOREIGN PATENT DOCUMENTS

CN 102127828 7/2011
WO 02081372 10/2002

OTHER PUBLICATIONS

International Search Report Form PCT/ISA/220, International Application No. PCT/US2014/052068, International Filing Date: Aug. 21, 2014—dated Dec. 2, 2014, pp. 1-14.
(Continued)

*Primary Examiner* — Daniel C McCracken
(74) *Attorney, Agent, or Firm* — Bond, Schoeneck & King, PLLC; William Greener; Alek Szecsy

(57) ABSTRACT

Described herein are nanofibers and methods for making porous carbon nanofibers. The pores have of any suitable size or shape. The presence and/or ordering of the pores results in a high surface area and/or high specific surface area. Such carbon is useful in a number of applications where high surface area carbon is desirable.

16 Claims, 11 Drawing Sheets

(51) Int. Cl.

| | |
|---|---|
| ***D01F 6/18*** | (2006.01) |
| ***D01D 5/00*** | (2006.01) |
| ***D01D 5/247*** | (2006.01) |
| ***D01F 1/08*** | (2006.01) |
| ***D01F 9/14*** | (2006.01) |

(52) U.S. Cl.
CPC ..... *D01F 1/08* (2013.01); *D01F 2/28* (2013.01); *D01F 6/18* (2013.01); *D01F 9/14* (2013.01); *D10B 2101/12* (2013.01); *D10B 2401/10* (2013.01)

(58) Field of Classification Search
CPC ..... D01F 2/28; D01F 9/12; D10B 2401/10; D10B 2101/12
See application file for complete search history.

(56) References Cited

U.S. PATENT DOCUMENTS

2007/0048521 A1* 3/2007 Istvan ..... D01F 9/20 428/367
2008/0070037 A1* 3/2008 Nonokawa ..... C04B 35/62277 428/401
2008/0296808 A1* 12/2008 Joo ..... D01D 5/0046 264/465
2010/0330419 A1* 12/2010 Cui ..... H01M 4/04 429/209
2013/0034804 A1 2/2013 Hong et al.
2013/0040140 A1* 2/2013 Joo ..... D01D 5/0069 428/401

OTHER PUBLICATIONS

Ozaki, et al., 1997, "Novel Preparation Method for the Production of Mesoporous Carbon Fiber From a Polymer Blend", Carbon, vol. 35, No. 7, pp. 1031-1033.

Hulicova, et al., 2003, "The Polymer Blend Technique As a Method for Designing Fine Carbon Materials", Carbon vol. 41, pp. 1443-1450.

Williams, et al., Nov. 7, 2013, "Controlling Micro and Meso Scaled Pores in Carbon Nanofibers From Immiscible Polymers for Energy Applications", In: AICHE Conference, Whole Document, pp. 1-24.

* cited by examiner

A

B

POROUS CARBON NANOFIBERS AND MANUFACTURING THEREOF

CROSS-REFERENCE

This application claims the benefit of U.S. Provisional Application No. 61/868,218, filed Aug. 21, 2013, which is incorporated herein by reference in its entirety.

BACKGROUND OF THE INVENTION

Nanotechnology is the manipulation of matter at an atomic and molecular scale and is a diverse field involving many different structures, techniques and potential applications. Of them, one structure is a nanofiber, which generally has a diameter of less than a few microns and can be of various lengths.

SUMMARY OF THE INVENTION

Nanostructured materials, including nanofibers, have potential for applications in a wide variety of fields including high performance filtration, chemical sensing, biomedical engineering and renewable energy. Many of these applications (e.g., heterogeneous catalysis) utilize the surface of the material (e.g., nanofiber), so benefit from materials (e.g., nanofibers) with a high surface area, a high porosity, and the like. Furthermore, some applications benefit from porous nanofibers that are substantially contiguous, long, coherent, flexible, non-brittle, and the like.

Described herein are nanostructured materials, including nanofibers, and methods for making nanostructured materials, including nanofibers, that have a plurality of pores. In various embodiments, the pores are of any suitable size or shape. In some embodiments the pores are or comprise "mesopores", having a diameter between 2 and 50 nm, or such pores have a diameter of between 2 and 100 nm or 3 and 100 nm, or 3 and 50 nm (reference to mesoporous material herein is generally understood to have pores of any such diameter, unless specifically stated otherwise). In some embodiments, nanofibers described herein have a high surface area and/or specific surface area (e.g., surface area per mass of nanofiber and/or surface area per volume of nanofiber). The nanostructured materials (e.g., nanofibers) and methods for making nanostructured materials (e.g., nanofibers) are optionally used in any suitable application, including without limitation, in batteries, capacitors, electrodes, solar cells, catalysts, adsorbers, filters, membranes, sensors, fabrics and/or tissue regeneration matrixes.

In certain embodiments, provided herein are high surface area carbon nanofibers. More specifically, provided herein are mesoporous carbon nanofibers. In some embodiments, provided herein is a mesoporous carbon nanofiber having a non-microporous (e.g., wherein micropores are less than 2 or 3 nm) pore size distribution (e.g., when plotting incremental pore area versus pore size, such as illustrated in FIG. 5) centered around a pore diameter of between 10 nm and 100 nm. In more specific embodiments, the non-microporous pore size distribution centered around a pore diameter of between 20 nm and 50 nm. In still more specific embodiments, the non-microporous pore size distribution is centered around a pore diameter of about 20 nm to about 35 nm. In some embodiments, provided herein is a mesoporous carbon nanofiber having a pore size distribution centered around a pore diameter of between 10 nm and 100 nm. In more specific embodiments, the pore size distribution is centered around a pore diameter of between 20 nm and 50 nm. In still more specific embodiments, the pore size distribution is centered around a pore diameter of about 20 nm to about 35 nm. In some embodiments, provided herein is a mesoporous carbon nanofiber with an incremental pore area of the mesopores is at least 50 $m^2/g$, e.g., about 50 $m^2/g$ to about 200 $m^2/g$, about 75 $m^2/g$ to about 150 $m^2/g$, or the like. In some embodiments, the incremental pore area of the nanofiber is at least 100 $m^2/g$, at least 250 $m^2/g$, at least 500 $m^2/g$, or the like. In some embodiments, the incremental pore area of the micropores is less than 350 $m^2/g$, e.g., less than 200 $m^2/g$, less than 100 $m^2/g$, or the like. In some embodiments, the nanofiber comprises a the non-microporous pore size distribution is centered around a pore diameter of about 10 nm to about 50 nm (e.g., about 20 nm to about 35 nm) and an incremental mesopore area of at least 50 $m^2/g$ (e.g., about 75 $m^2/g$ to about 150 $m^2/g$). In specific instances, such measures (in particular, e.g., the determination of where the pore size distribution is centered around) are determined by measuring the incremental pore areas for pore sizes between 2 and 100 nm or between 3 and 100 nm.

In some embodiments, provided herein is a process for producing a mesoporous carbon nanofiber, the process comprising:

a. electrospinning a fluid stock to produce a nanofiber, the fluid stock comprising a first polymer component and a second polymer component; and
b. thermally treating the nanofiber to produce a mesoporous carbon nanofiber.

In some embodiments, the first polymer component carbonizes upon the thermal treatment (a "carbonizing polymer") and the second polymer component is a sacrificial polymer component (e.g., is removed (e.g., at least partially) upon thermal treatment or a (e.g., previous) chemical treatment, such as preferential dissolution in a solvent in which the first polymer component is not soluble (e.g., water, acetone, hydrocarbon, halocarbon (such as dichloromethane), alcohol (such as ethanol), or the like). In specific embodiments, the second polymer component is sacrificed (e.g., removed by degradation, sublimation, or the like) during thermal treatment. In other embodiments, the second polymer component is preferentially dissolved prior to carbonization (e.g., wherein the first polymer is a non-water soluble polymer and the second is a water soluble polymer, and the second polymer is selectively dissolved and removed).

In some embodiments, e.g., wherein porous polymer or carbon materials (e.g., nanofibers) are prepared, chemically and/or thermally treating the nanofiber comprises selectively removing one of the polymers from the nanofiber to create a porous or mesoporous material. In certain embodiments, selective removal of a polymer is achieved in any suitable manner, e.g., depending on the polymer utilized (e.g., by heating, by ozonolysis, by treating with an acid, by treating with a base, by treating with solvent (e.g., acetone) or water, by combined assembly by soft and hard (CASH) chemistries, or any combination thereof). In certain embodiments, e.g., wherein porous or mesoporous carbon materials are prepared, after removal of the polymer, thermal treatment of the material provides porous or mesoporous carbon material.

In various embodiments, any suitable combination of polymers is utilized. In certain embodiments, the polymers are different from one another. In some embodiments, the polymers are present in any suitable ratio, such as 1:1 (based on weight, number of monomeric residues, or the like), 1:2, 1:3, or the like. In certain embodiments, the ratio of first polymer to second polymer is any suitable ratio for preparing the mesoporous nanofibers, such as 10:1 to 1:10. In more specific embodiments, the ratio of first polymer to second polymer is 10:1 to 1:4 (e.g., 4:1 to 1:4 or 4:1 to 1:2 or 2:1 to 1:2). In some embodiments, each polymer has a minimum of at least 10 monomeric residues. In more specific embodiments, each polymer has a minimum of at least 20 monomeric residues, or at least 30 monomeric residues.

In some embodiments, the first and second polymers have an affinity for themselves and/or an aversion to each other (or an insolubility in each other). In some embodiments, the first polymer is hydrophilic and the second polymer is hydrophobic or lipophilic (including, e.g., wherein the first polymer is more hydrophilic than the second polymer, or the second polymer is more hydrophobic than the first polymer). In some embodiments, at least one polymer comprises (e.g., on monomeric residues thereof) alcohol groups, ether groups, amine groups, or combinations thereof (or other nucleophilic groups) (e.g., to associate with a metal precursor—e.g., to provide high precursor loading and dispersion characteristics, as described herein).

In some embodiments, the first polymer is polyacrylonitrile (PAN), polyvinylacetate (PVA), polyvinylpyrrolidone (PVP), a cellulose (e.g., cellulose), a polyalkylene (e.g., ultra-high molecular weight polyethylene (UHMWPE)), or the like. In certain embodiments, the first polymer is styrene-co-acrylonitrile (SAN), or m-aramid. In certain embodiments, the second (e.g., sacrificial) polymer is a polyalkyleneoxide (e.g., PEO), polyvinylacetate (PVA), a cellulose (e.g., cellulose acetate, cellulose diacetate, cellulose triacetate, cellulose), nafion, polyvinylpyrrolidone (PVP), acrylonitrile butadiene styrene (ABS), polycarbonate, a polyacrylate or polyalkylalkacrylate (e.g., polymethylmethacrylate (PMMA)), polyethylene terephthalate (PET), nylon, polyphenylene sulfide (PPS), or the like. In some embodiments, the second polymer is styrene-co-acrylonitrile (SAN), polystyrene, a polymimide or an aramid (e.g., m-aramid). In specific embodiments, the second polymer is a cellulose, a polyimide or an aramid. Generally, the first and second polymers are different.

In some embodiments, processing of the fluid stock comprises electrospinning the fluid stock into a first (precursor/as spun) nanofiber. In some embodiments, the fluid stock is mono-axially spun (i.e., a single fluid electrospun about an axis). In certain embodiments, the fluid stock is co-axially spun with at least one additional fluid (i.e., at least two fluids electrospun about a common axis). In some embodiments, the fluid stock is spun with a gas, in a gas-assisted manner. In some instances, electrospinning with gas improves electrospinning throughput and morphology. In some specific embodiments, the fluid stock is co-axially spun with at least one additional fluid stock and a gas (i.e., wherein all fluids are electrospun about a common axis).

In some embodiments, the process provided herein comprises thermally stabilizing or annealing the nanofiber. In certain embodiments, thermal stabilization/annealing changes the internal packing and/or chemical structure of the material. In some embodiments, stabilizing/annealing increases the packing ordering of the material. In certain embodiments, annealing provides a change in the ordering of the internal structure of the material (e.g., from disordered to micelle, and/or micelle to lamellae, etc.). In certain embodiments, annealing provides a material (e.g., nanofiber) having ordered phase elements comprising spheres, cylinders (rods), layers, channels, gyroids, or any combination thereof. In certain embodiments, the nanostructure of a nanofiber provided herein comprising a polymer blend or combination provides for small (e.g., nanoscale, such 1-200 nm scale, such as as mesoporous) structures to be formed when annealing the polymer blend.

In various embodiments, annealing is performed at any suitable temperature. In some embodiments, annealing is performed at room temperature. In other embodiments, annealing is performed at a temperature of less than 500° C., 100° C. to 500° C., 50° C. to 300° C., e.g., 50° C. to 200° C. In specific embodiments, annealing is performed for a time sufficient to provide the internal structural organization or reorganization desired. In some embodiments, stabilizing/annealing is performed for any suitable time, such as 1 to 48 hours. In specific embodiments, stabilizing/annealing is performed for 2 to 24 hours.

In certain embodiments, provided herein is a nanofiber comprising a (or a plurality of nanofibers comprising an average) surface area of at least $10 \pi r h$, wherein r is the radius of the nanofiber and h is the length of the nanofiber. In some embodiments, provided herein is a nanofiber comprising a (or a plurality of nanofibers comprising an average) specific surface area of at least 10 $m^2/g$ (e.g., at least 30 $m^2/g$, at least 100 $m^2/g$, at least 300 $m^2/g$, at least 500 $m^2/g$, at least 700 $m^2/g$, at least 800 $m^2/g$, at least 900 $m^2/g$, or at least 1000 $m^2/g$, e.g., as measured by BET). In certain embodiments, provided herein is a nanofiber comprising a (or a plurality of nanofibers comprising an average) porosity of at least 20% (e.g., at least 30%, at least 40%, at least 50%) and a length of at least 1 nm. In some embodiments, provided herein is a nanofiber (or a plurality of nanofibers) comprising a plurality of nanostructured pores, the pores having an average (BJH) pore diameter of 2-100 nm (e.g., 3-100 nm, 2-50 nm, 3-50 nm, 5-50 nm, 2-25 nm, 3-25 nm, or the like). In some embodiments, provided herein is a nanofiber (or a plurality of nanofibers) comprising a plurality of pores and a maximum incremental non-microporous (e.g., <2 nm or <3 nm) pore volume at an average pore diameter of less than 200 nm (e.g., less than 100 nm, less than 50 nm, less than 25 nm, less than 20 nm, less than 10 nm, less than 7 nm, less than 5 nm) (e.g., as measured by BET). In certain embodiments, provided herein is a nanofiber (or plurality of nanofibers) comprising a plurality of pores (e.g., nanoscaled pores), the pores having a substantially uniform size (e.g., at least 80% of the porous incremental pore volume being from pores having a diameter within 50 nm (or 20 nm, 10 nm, 5 nm, 3 nm) of the pore diameter having the maximum incremental porous pore volume). In some embodiments, provided herein is a nanofiber (or plurality of nanofibers) comprising a plurality of pores (e.g., mesopores), the pores ordered in a cubic-type morphology, hexagonal-type morphology, reverse hexagonal-type morphology, lamellar-type morphology, gyroid-type morphology, bi-continuous morphology, helical-type morphology, assembled micelle-type morphology, or a combination thereof.

In one aspect, described herein are the nanofiber produced by a step or method of any of the methods described herein.

In one aspect, described herein is a composition comprising a plurality of nanofibers described herein. In certain aspects, provided herein is a plurality of nanofibers comprising an average of any of the characteristic described herein for a single nanofiber.

In one aspect, described herein is a composition comprising a plurality of the nanofibers described herein, wherein the nanostructured material (e.g., plurality of nanofibers) comprise a specific surface area of at least 10 $m^2/g$ (e.g., at least 100 $m^2/g$). In specific aspects, provided herein is a nanostructured material (e.g., plurality of nanofibers) having a specific surface area of at least 50 $m^2/g$ (e.g., at least 700

$m^2/g$). In specific aspects, provided herein is a nanostructured material (e.g., plurality of nanofibers) having a specific surface area of at least 100 $m^2/g$ (at least 1000 $m^2/g$).

In one aspect, described herein is a battery, capacitor, electrode, solar cell, catalyst, adsorber, filter, membrane, sensor, fabric, or tissue regeneration matrix comprising the nanofibers described herein.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

DETAILED DESCRIPTION OF THE INVENTION

Figure 1:
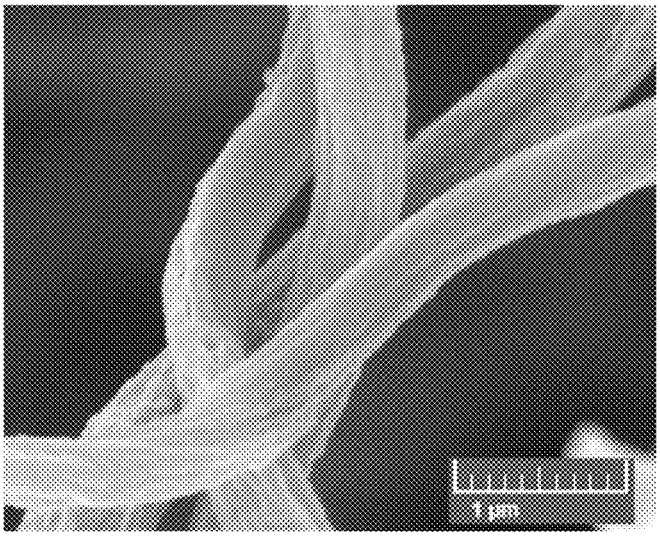
FIG. 1 illustrates an SEM image of the collected nanofibers prepared from an exemplary polymer mixture (PAN and CDA).

Described herein are nanostructured materials (e.g., nanofibers) and methods for making high surface area nanofibers (e.g., carbon nanofibers), and/or nanofibers (e.g., carbon nanofibers) that have a plurality of pores. The pores may be of any suitable size. In certain embodiments, the pores are nanostructured pores, e.g., having diameters of about 1 nm to about 500 nm, e.g., about 1 nm to about 200 nm. In some embodiments the pores are mesopores, having a diameter between 2 and 50 nm. In some embodiments, the pores are micropores, having a diameter of less than 2 nm or less than 3 nm. In yet other embodiments, the pores are macropores, having a diameter greater than 50 nm. However nanofibers having pores of any size, and methods for making nanofibers having pores of any size, are within the scope of the disclosure provided herein. In further or alternative embodiments, the nanofibers described herein are porous nanofibers having a high surface area. In specific embodiments, the nanofibers described herein are porous nanofibers having ordered pores and a high surface area.

Pores

In some embodiments, described herein are nanostructured materials (e.g., nanofibers) comprising a plurality of pores (e.g., mesopores). In specific embodiments, such pores are ordered (e.g., present in the nanofiber in a non-random configuration). In one aspect, ordered pores provide a nanostructured material (e.g., nanofiber) having a higher surface area, a more contiguous nanostructured material (e.g., nanofiber), a more flexible nanostructured material (e.g., nanofiber) and/or less brittle nanostructured material (e.g., nanofiber) when compared with a nanostructured material (e.g., nanofiber) lacking pores, or lacking ordered pores, but of an otherwise similar or identical material.

In some embodiments, the pores have an average characteristic dimension of about 5 nm, about 10 nm, about 25 nm, about 50 nm, about 100 nm, about 200 nm, about 500 nm, and the like. In some embodiments, the pores have an average characteristic dimension of at least 2 nm, at least 5 nm, at least 10 nm, at least 25 nm, at least 50 nm, at least 100 nm, at least 200 nm, at least 500 nm, and the like. In some embodiments, the pores have an average characteristic dimension of at most at most 10 nm, at most 25 nm, at most 50 nm, at most 100 nm, at most 200 nm, at most 500 nm, and the like.

In specific embodiments, pores of nanostructures provided herein have an average diameter of 2-50 nm or 3 nm to 50 nm (mesoporous). In some embodiments, nanostructures provided herein comprise a plurality of mesoporous structures. In some embodiments, the plurality of mesoporous structures have an average diameter of 2-20 nm or 3-20 nm. In some embodiments, the mesopores have a maximum incremental pore volume at an average pore diameter of less than 50 nm. In some embodiments, the mesopores have a maximum incremental pore volume at an average pore diameter of less than 25 nm.

In some embodiments, provided herein are nanofibers (e.g., nanofibers comprising mesopores) having a cumulative pore area (e.g., cumulative mesopore area) of at least 40 $m^2/g$ (e.g., as measured by BJH). In specific embodiments, provided herein are nanofibers (e.g., nanofibers comprising mesopores) having a cumulative pore area (e.g., cumulative mesopore area) of at least 50 $m^2/g$. In more specific embodiments, provided herein are nanofibers (e.g., nanofibers comprising mesopores) having a cumulative pore area (e.g., cumulative mesopore area) of at least 75 $m^2/g$. In more specific embodiments, provided herein are nanofibers (e.g., nanofibers comprising mesopores) having a cumulative pore area (e.g., cumulative mesopore area) of at least 100 $m^2/g$.

In some embodiments, provided herein are nanofibers (e.g., nanofibers comprising mesopores) having a cumulative pore volume (e.g., cumulative mesopore volume) of at least 0.05 $cm^3/g$ (e.g., as measured by BJH). In specific embodiments, provided herein are nanofibers (e.g., nanofibers comprising mesopores) having a cumulative pore volume (e.g., cumulative mesopore volume) of at least 0.1 $cm^3/g$ (e.g., as measured by BJH). In specific embodiments, provided herein are nanofibers (e.g., nanofibers comprising mesopores) having a cumulative pore volume (e.g., cumulative mesopore volume) of at least 0.2 $cm^3/g$ (e.g., as measured by BJH).

In some embodiments, a nanofiber (e.g., nanofibers comprising mesopores or ordered mesopores) provided herein has a surface area (e.g., as measured by BET) of at least 100 $m^2/g$. In specific embodiments, a nanofiber (e.g., nanofibers comprising mesopores or ordered mesopores) provided herein has a surface area (e.g., as measured by BET) of at least 250 $m^2/g$. In yet more specific embodiments, a nanofiber (e.g., nanofibers comprising mesopores or ordered mesopores) provided herein has a surface area (e.g., as measured by BET) of at least 500 $m^2/g$.

In some embodiments, pore diameters are measured using any suitable technique. In exemplary embodiments, surface area, pore size, volume, diameter, or the like is optionally measured by transmission electron microscopy (TEM), scanning electron microscopy (SEM), by Brunauer-Emmett-Teller (BET) surface area analysis, by Barrett-Joyner-Halenda (BJH) pore size and volume analysis, or the like.

In certain embodiments, the nanostructures comprise a plurality of pores, at least 50%, at least 70%, at least 80%, or at least 90% of the pores (e.g., non-micropores, or mesopores) incremental pore volume being from pores having a diameter within 50 nm, 25 nm, 10 nm, 5 nm, 200%, 100%, 50%, or the like of the pore diameter having the maximum incremental nanostrucutured or mesoporous pore volume (e.g., as determined using a BET distribution chart).

In some embodiments, the pores have a substantially uniform size. The plurality of pores (e.g., non-micropores, or mesopores) have a characteristic dimension as described herein. In some embodiments, the pores are of a substantially uniform size when the standard deviation of the characteristic dimension (e.g., diameter, depth, etc.) is about 5%, about 10%, about 15%, about 20%, about 30%, about 50%, about 100%, and the like of the average value of the characteristic dimension. In some embodiments, the pores are of a substantially uniform size when the standard deviation of the characteristic dimension is at most 5%, at most 10%, at most 15%, at most 20%, at most 30%, at most 50%, at most 100%, and the like of the average value of the characteristic dimension. In some embodiments, the pores do not have a substantially uniform size. Also, provided in certain embodiments herein are nanofibers comprising a combination of polymers. In some embodiments, the combination of polymers are blended (e.g., not forming a mixture), or comprising a matrix of a first polymer with discrete domains of a second polymer (such first and second polymers being, e.g., as described herein). In some embodiments, the domains characteristics (e.g, size, distribution, and the like) are suitable to provide mesoporous nanofibers described herein. For example, in various embodiments, the discrete domains have dimensions of pores described herein (e.g., such that upon their sacrificial removal, pores, such as described herein, are left behind in the polymer or carbon matrix). It is to be understood a that any description of a pore characteristic herein is also intended to be descriptive of a discrete second polymer domain of a nanofiber comprising a first polymer matrix and discrete domains of a second polymer component.

Nanofibers with a High Surface Area

In various aspects, the nanostructured materials (e.g., nanofibers) have a high surface area and methods are described for making nanofibers having a high surface area. In some instances, ordering of the pores results in a higher surface area and/or specific surface area (e.g., surface area per mass of nanofiber and/or surface area per volume of nanofiber). For example, in some instances, ordering of the nanofibers allows for greater pore packing/concentration in the nanostructured material (e.g., nanofiber). In some embodiments, the porous nanofibers have a specific surface area of at least 10 $m^2/g$, at least 50 $m^2/g$, at least 100 $m^2/g$, at least 200 $m^2/g$, at least 500 $m^2/g$, at least 1,000 $m^2/g$, at least 2,000 $m^2/g$, at least 5,000 $m^2/g$, at least 10,000 $m^2/g$, and the like. In specific embodiments, the porous nanofibers have a specific surface area of at least 100 $m^2/g$. In more specific embodiments, the porous nanofibers have a specific surface area of at least 300 $m^2/g$. In still more specific embodiments, the porous nanofibers have a specific surface area of at least 500 $m^2/g$.

In some embodiments, the porous nanofibers are cylindrical. Neglecting the area of the two circular ends of a cylinder, the area of the cylinder is estimated to be two times the mathematical constant pi ($\pi$) times the radius of the cross section of the cylinder (r) times the length of the nanofiber (h), (i.e., $2 \pi r h$). In some embodiments, the surface area of the porous nanofiber is greater than $2 \pi r h$. In some embodiments, the surface area of the porous nanofiber is about $4 \pi r h$, about $10 \pi r h$, about $20 \pi r h$, about $50 \pi r h$, about $100 \pi r h$, and the like. In some embodiments, the surface area of the porous nanofiber is at least $4 \pi r h$, at least $10 \pi r h$, at least $20 \pi r h$, at least $50 \pi r h$, at least $100 \pi r h$, and the like.

Methods for measuring the length of a nanofiber include, but are not limited to microscopy, optionally transmission electron microscopy ("TEM") or scanning electron microscopy ("SEM"). The nanofiber can have any suitable length. A given collection of nanofibers would be expected to have nanofibers that have a distribution of fibers of various lengths. Therefore, certain fibers of a population may accordingly exceed or fall short of the average length. In some embodiments, the nanofiber has an average length of at least about 1 μm, at least about 5 μm, at least about 10 μm, at least about 20 μm, at least about 50 μm, at least about 100 μm, at least about 500 μm, at least about 1,000 μm, at least about 5,000 μm, at least about 10,000 μm, at least about 50,000 μm, at least about 100,000 μm, at least about 500,000 μm, and the like. In some embodiments, the nanofiber has any of these (or other suitable) lengths in combination with any of the porosities described herein (e.g., 20%). In some embodiments, the nanofibers have high aspect ratio, such as at least 10, at least 100, at least $10^3$, at least $10^4$, at least $10^5$, or greater.

In one aspect, the nanofiber has a high porosity and is substantially contiguous. A nanofiber is substantially contiguous if when following along the length of the nanofiber, fiber material is in contact with at least some neighboring fiber material over substantially the entire nanofiber length. "Substantially" the entire length means that at least 80%, at least 90%, at least 95%, or at least 99% of the length of the nanofiber is contiguous. In some embodiments, the nanofiber is substantially contiguous in combination with any of the porosities described herein (e.g., 35%).

Process for Making Porous Nanofibers

Described herein are methods for producing porous (e.g., mesoporous) carbon nanofibers. The method comprises producing a (precursor) nanofiber that comprises at least two components (e.g., at least two different types of polymers), optionally annealing or stabilizing (e.g., thermally) the nanofiber (e.g., to order the two components within and/or nanofiber), optionally treating the nanofiber to selectively removing at least one of the components from the nanofiber (e.g., by washing with a solvent in which one of the polymer components is soluble); and carbonizing the nanofiber (e.g., carbonizing the first polymer, the second polymer being sacrificially removed by previous chemical treatment or during the carbonization process).

In some instances, the polymer components have the capability of self-organizing. However, in certain instances, they will be initially disorganized when first prepared (e.g., nanofibers emerging from the electrospinner). In some embodiments, the polymer components self-organize into a more ordered configuration, self-organize into ordered phase elements or re-organize into different phase elements in the as-prepared material (e.g., as-spun nanofiber). In some embodiments, an annealing step results in ordering or re-ordering of the phase elements. In some instances, annealing provides sufficient energy to overcome an activation energy for phase transition from a less ordered state to a more ordered state, from an unordered state to an ordered state, or from a first ordered state to a second ordered state. In some embodiments, ordering is by like-component to like-component (e.g., hydrophobic polymer components assembling into a hydrophobic phase element).

In some embodiments, the nanofiber is coated prior to annealing (e.g., concurrent with preparation or subsequent to preparation). In some embodiments, the coating allows the nanofiber to retain its fiber morphology upon thermal treatment or inhibit other adverse effects (e.g., swelling of the material/nanofiber). In some embodiments, the coating is applied by co-axial electrospinning as described herein. Other methods suitable for applying the coating include dipping, spraying, electro-deposition for example. Following annealing, the coating is optionally removed (e.g., a thermally stable silica—such as prepared by electrospinning a TEOS-based sol-gel stock around the polymer stock—is optionally removed by etching with NaOH).

In some embodiments, one or more of the components are selectively removed from the nanofibers, e.g., following annealing, to produce ordered pores. Methods suitable for selectively removing material from the ordered materials (e.g., nanofiber(s)) are described herein.

In some embodiments, a fluid stock comprising a combination of polymer types (e.g., PI and PS, PS and PLA, PMMA and PLA, or other copolymer described herein) is electrospun. In specific embodiments, the fluid stock is coaxially electrospun with a second fluid stock, the second fluid stock comprising a coating agent (or coating agent precursor), such as a carrier polymer or a ceramic sol gel precursor system. In some instances, an inner jet of a polymer combination/blend is formed from the fluid stock, with an outer jet formed from the second fluid stock, is prepared as a result of the coaxial electrospinning Nanofibers are generally collected on a collector. Collected nanofibers are optionally annealed, e.g., to order the polymer combination (e.g., as spheres, cylinders, perforated layers, lamellae). In some instances, one polymer (e.g., the PI or PLA, or CDA) is removed (e.g., via selective dissolution, ozonolysis or treating with a base). In further or additional instances, the outer layer of the nanofiber is also removed (by the same or different process of removing the one polymer). In some embodiments, such a process is utilized to yield porous (e.g., mesoporous) polymeric nanofibers.

Figure 4:
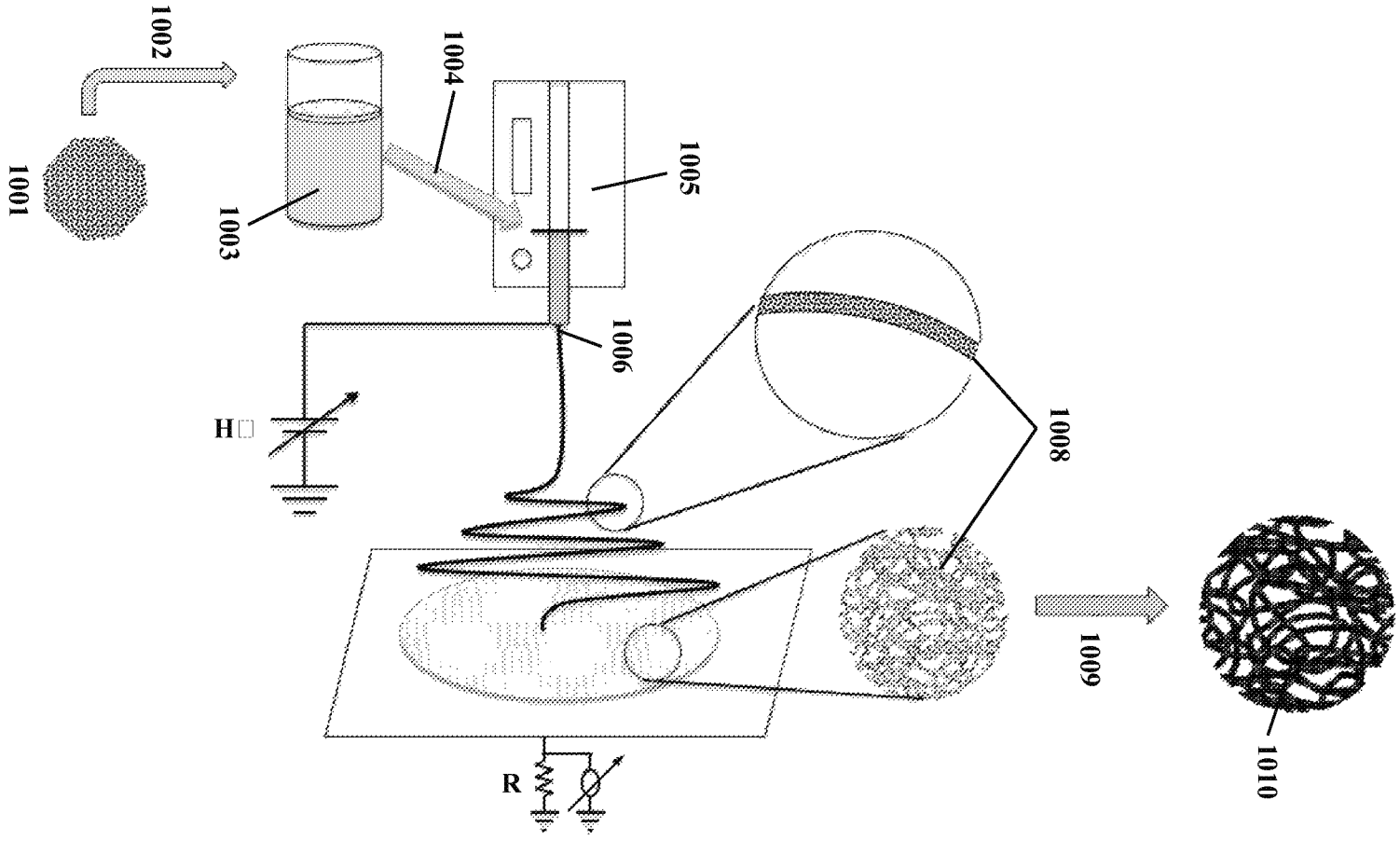
FIG. 4 illustrates one embodiment of a system and method for producing porous (e.g., mesoporous) carbon nanofibers via gas-assisted electrospinning.

FIG. 4 illustrates certain embodiments for producing porous (e.g., mesoporous) nanofibers described herein (e.g., mesoporous carbon nanofibers). In some embodiments, polymer combination (i.e., at least two different polymer types) 1001 is used to preared (e.g., with a fluid, such as water, alcohol, or solvent) to prepare 1002 a fluid stock 1003. The fluid stock is provided 1004 to an electrospinning apparatus (e.g., using a syringe 1005). In some instances the fluid stock is electrospun via a needle (e.g., a coaxial needle) 1006, with optional gas assistance (e.g., coaxial gas assistance). In some instances, an inner jet of the fluid stock is electrospun with an outer jet of air (e.g., coaxial gas assistance). Nanofibers 1008 are generally collected on a collector 1007. Collected nanofibers are optionally annealed (e.g., to order the polymer components). In some instances, thermal (and/or chemical) treatment 1009 yields porous (e.g., nanostructured or mesoporous) nanofibers 1010 (e.g., mesporous carbon nanofibers). In some instances, if a metal precursor is provided in the fluid stock, mesoporous ceramic or metal nanofibers are optionally obtained.

Methods for Electrospinning

Figure 8:
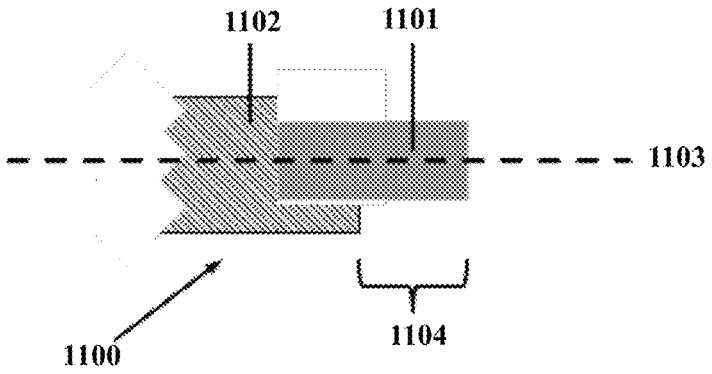
FIG. 8 illustrates common-axial (co-axial) electrospinning apparatus, having an inner needle and an outer needle coaxially aligned about a common axis. In some instances, the inner and outer needles are configured to coaxially electrospin the fluid stock through the inner needle and gas through the outer needle. In some such instances, the inner and outer needles are configured to electrospin a first fluid stock along with a gas.

In one aspect, described herein is a method for producing porous nanofiber(s) that comprises electrospinning a fluid stock that comprises at least two polymer components. In some instances, such components form distinct phase elements, and at least one of which is removable (e.g., sacrificial) as described herein (e.g., by selective dissolution and/or thermal treatment). Any suitable method for electrospinning is used. In some embodiments, polymer melt or polymer solution (aqueous, alcohol, DMF, or other solvent based solution) electrospinning is optionally utilized. In specific embodiments, aqueous solution electrospinning is utilized. In other specific embodiments, alcohol solution electrospinning is utilized. In certain embodiments, co-axial electrospinning is utilized. In general, co-axial electrospinning is to be understood to include electrospinning of at least two fluids about a common axis. In some instances, two, three, or four fluids are electrospun about a common axis. In some embodiments, at least one of the co-axially spun fluids is a gas (thereby rendering the electrospinning gas assisted). In some instances, a common axis is an axis that is substantially similar to the axis through which a first fluid is electrospun, e.g., within 5 degrees, within 3 degrees or within 1 degree of the first fluid. FIG. 8 illustrates co-axial electrospinning apparatus 1100. The coaxial needle apparatus comprises an inner needle 1101 and an outer needle 1102, both of which needles are coaxially aligned around a similar axis 1103. In some embodiments, further coaxial needles may be optionally placed around, inside, or between the needles 1101 and 1102, which are aligned around the axis 1103. In some instances, the termination of the needles is optionally offset 1104.

Any suitable electrospinning technique is optionally utilized. For example, elevated temperature electrospinning is described in U.S. Pat. No. 7,326,043 filed on Oct. 18, 2004; U.S. patent application Ser. No. 13/036,441 filed on Feb. 28, 2011; and U.S. Pat. No. 7,901,610 filed on Jan. 10, 2008, which are incorporated herein for such disclosure. In some embodiments, the electro-spinning is gas-assisted as described in PCT Patent Application PCT/US11/24894 filed on Feb. 15, 2011, which is incorporated herein for such disclosure. Briefly, gas-assisted electrospinning comprises expelling a stream of gas at high velocity along with the fluid stock (e.g., as a stream inside the fluid stock or surrounding the fluid stock). In some instances, gas-assisted electrospinning, increases the through-put of an electrospinning process, the morphology of a resultant nanofiber, or the like.

In some embodiments, the method comprises co-axially electrospinning a first fluid stock with a second fluid stock to produce a first nanofiber. Exemplary co-axial electrospinning techniques are described in PCT Patent Application PCT/US11/24894 filed on Feb. 15, 2011, which is incorporated herein for such disclosure. In some embodiments, the first fluid stock comprises at least two polymer components (e.g., at least two different types of polymer), the second fluid stock comprises a coating agent, and the first nanofiber comprises a first layer (e.g., a core) and a second layer (e.g., a coat) that at least partially coats the first layer. In addition, a gas is optionally co-axially electrospun with the first and second fluid stocks.

In some embodiments, provided herein is a power supply configured to provide voltage to the nozzle component (e.g., to provide the electric force sufficient to electrospin nanofibers from a polymer liquid—e.g., polymer solution or melt). In some embodiments, the voltage supplied to the nozzle component is any suitable voltage, such as about 10 kV to about 50 kV. In more specific embodiments, the voltage supplied is about 20 kV to about 30 kV, e.g., about 25 kV. In some embodiments, the fluid stock has any suitable viscosity, such as about 10 mPa·s to about 10,000 mPa·s (at 1/s, 20° C.), or about 100 mPa·s to about 5000 mPa·s (at 1/s, 20° C.), or about 1500 mPa·s (at 1/s, 20° C.). In certain embodiments, fluid stock is provided to the nozzle at any suitable flow rate. In specific embodiments, the flow rate is about 0.01 to about 0.5 mL/min. In more specific embodiments, the flow rate is about 0.05 to about 0.25 mL/min. In still more specific embodiments, the flow rate is about 0.075 mL/min to about 0.125 mL/min, e.g., about 0.1 mL/min. In some embodiments, at least one manifold supply chamber contains therein a fluid consisting essentially of gas (e.g., air). In certain embodiments, the nozzle velocity of the gas is any suitable velocity, e.g., about 0.01 m/s or more. In specific embodiments, the nozzle velocity of the gas is about 1 m/s to about 300 m/s. In certain embodiments, the pressure of the gas provided (e.g., to the manifold inlet or the nozzle) is any suitable pressure, such as about 1 psi to 50 psi. In specific embodiments, the pressure is about 2 psi to about 20 psi.

Fluid Stocks

In various embodiments, various processes are utilized to prepare a first (as prepared) material from a fluid stock described herein. In some aspects the methods described herein comprise electrospinning a fluid stock. In other instances, fluid stocks described herein are optionally cast, spin coated, or the like to prepare a first material which may then be converted to a nanostructured material according to the processes described herein. In some embodiments, electrospinning of the electrospun fluid stock produces a nanofiber.

In some embodiments, the fluid stocks are solvent-based (e.g., comprise an organic solvent such as hexane) or aqueous (i.e., water-based or containing). In specific embodiments, fluid stocks suitable for producing metal, ceramic, metal alloy, or any combination thereof (e.g., hybrid/composite nanofibers) comprise a water soluble polymer and precursor molecules. In specific instances, such combinations are distributed substantially uniformly on one of the polymer components over the other (e.g., via an association, such as a condensation reaction, between the precursor and a monomeric residue). Such association are more thoroughly described in International Patent Application PCT/US12/53097, filed Aug. 30, 2012, U.S. patent application Ser. No. 13/451,960, filed Apr. 20, 2012, and published as US 2012/0282484 on Nov. 8, 2012, and U.S. Provisional Patent Publication No. 61/528,895 filed on Aug. 30, 2011, which are incorporated herein for such disclosure and the disclosure of various metal precursors.

In specific embodiments, the fluid stock comprises at least two polymer components. In more specific embodiments, the fluid stock comprises at least two polymers and a precursor. In still more specific embodiments, the fluid stock comprises a at least two polymers and a metal precursor. In yet more specific embodiments, the fluid stock comprises hydrophobic polymer (e.g., more hydrophobic than the other polymer), a hydrophilic polymer (e.g., more hydrophilic than the other polymer), and a metal precursor. In some embodiments, the fluid stock comprises at least two polymer components and a sol gel system (e.g., as prepared by the combination of TEOS, ethanol and HCl(aq)). In specific embodiments, the fluid stock comprises or is prepared by the combination of (i) at least two polymers, (ii) a sol-gel precursor (e.g., TEOS), (iii) alcohol or water, and (iv) an optional acid (e.g., aqueous HCl).

In some embodiments, precursors include materials that are optionally converted to another material upon treatment of the as-spun or annealed material. For example, in some instances, the precursor is a metal precursor (which may be converted to a metal, a metal oxide, a ceramic, or the like), ceramic (sol gel) precursor, carbon precursor, or any combination thereof in various embodiments. In some embodiments, a carbon precursor is a polymer (e.g., polyacrylonitrile or other carrier polymer described herein), wherein thermal treatment of the electrospun fluid stock is capable of converting the carbon precursor into a continuous carbon matrix (e.g., a carbon nanofiber).

In some embodiments, fluid stocks described herein optionally comprise nanoparticles (e.g., of any suitable shape). In some embodiments, such nanoparticles comprise metal component nanoparticles, metal nanoparticles (e.g., single metal or metal alloy), metal oxide nanoparticles, ceramic nanoparticles, nanoclay nanoparticles, or the like. In some instances, such metal components, metals, metal oxides, ceramics, etc. are optionally any such metal components, metals, metal oxides, ceramics, etc. described for the nanostructured materials (e.g., porous nanofibers) or precursors described herein. Moreover, nanoclays as described in U.S. Pat. No. 7,083,854 filed on May 10, 2005, are optionally utilized. Components of fluid stocks, as described in U.S. patent application Ser. No. 11/694,435 filed on Mar. 30, 2007 or PCT Patent Application No. PCT/US10/35220 filed on May 18, 2010, are optionally utilized in the fluid stocks herein, which references are incorporated herein for such disclosure.

In some embodiments, a fluid stock described herien comprises a metal precursor (e.g., in processes wherein mesoporous ceramic or metal nanofibers are manufactured) or a combination of polymer and metal precursor (which metal precursor may disassociate or reassociate with the polymer in combination with the polymer solution). In some embodiments, the metal precursor is a metal salt (in associated or disassociated form) that is capable of being converted to a metal or ceramic material upon thermal treatment (e.g., calcination or thermal reductive processes). In some embodiments, the precursor is a metal carboxylate (e.g., metal acetate), a metal alkoxide (e.g., ethoxide), a metal halide (e.g., chloride), a metal diketone (e.g., acetylacetone), or a combination thereof. Any suitable metal (including metalloids, such as silicon) is optionally utilized, such as aluminum, iron, cobalt, copper, zinc, titanium, zirconium, or the like, or combinations thereof. In some embodiments, the precursor is only or preferentially soluble in one of the polymer components, which, in some instances, results in a much higher concentration of the precursor in a phase element formed by the self-assembly of the preferred polymer component. In some embodiments, calcination of the nanofiber converts the precursor to nanofiber material only in certain portions of the nanofiber, resulting in a porous (e.g., mesoporous) ceramic or metal nanofiber.

Polymers

In some embodiments, the fluid stock and/or electro spun precursor nanofiber comprises at least two polymer components (e.g., a first and second polymer). In some embodiments, the polymers are of different types. In specific embodiments, polymer combinations provided herein comprise polymers that are preferentially miscible with themselves, or are incompatible with one another (e.g., immiscible in each other). In certain instances, microphase separation provided herein results because of such preference and/or incompatability.

In some embodiments, a suitable polymer combinations comprise a first polymer and a second polymer, the first and second polymers having an affinity for themselves and/or an aversion to each other (or an insolubility in each other). In some embodiments, a suitable polymer combination comprises a first polymer and a second polymer, wherein the first polymer is hydrophilic and the second polymer is hydrophobic or lipophilic (including, e.g., wherein the first polymer is more hydrophilic than the second polymer, or the second polymer is more hydrophobic than the first polymer).

In some embodiments, a polymer combination provided herein comprises a first polymer is a carbonizing polymer (e.g., a polymer that carbonizes at high thermal temperatures). In certain embodiments, a polymer combination provided herein comprises a second polymer that is a sacrificial polymer (e.g., a polymer that is removed (e.g., at least partially) at high thermal temperatures—e.g., through decomposition, sublimation, or the like, or preferentially in a solvent (e.g., a solvent in which the first polymer component is not soluble). In certain embodiments, carbonization of the first polymer component and sacrifice of the second polymer component in a precursor nanofiber (e.g., in a single thermal treatment step, a two step process comprising preferential dissolution of the second polymer component and subsequent carbonization of the first polymer) provided herein results in a mesoporous carbon nanofiber provided herein. Preferential solubility are determined by any suitable method, for example, treatment of a sample of bulk material of the first and second polymers can differentially be tested in a solvent for solubility thereof (e.g., measuring non-dissolved polymer after a desired time period), using published solubility tables, or the like. Similarly, suitable materials and temperatures are determined by any suitable method, such as using thermal gravimetric analysis (TGA) and/or differential scanning calorimetry (DSC) of the first and second polymers to optionally determine polymers that carbonize and/or are sacrificed at specific temperatures and conditions, using published decomposition and carbonization parameters, or the like.

In some embodiments, a polymer combination provided herein comprises a first and a second polymer. In some embodiments, the second polymer is differentially soluble from the first polymer. In exemplary embodiments, the first polymer is not water soluble (e.g., UHMWPE, PAN, or the like) and the second polymer is water soluble (e.g., PEO, PVA, PVP, or the like), or the first polymer is not soluble in acetone (e.g., UHMWPE, PAN, or the like), and the second polymer is soluble in acetone (e.g., CDA). In some embodiments, the first and second polymers are differentially thermally decomposable, wherein the first polymer carbonizes at a specific temperature and the second polymer is removed (e.g., by sublimation, degradation, etc.) at the same temperature. Any suitable molecular weight is optionally utilized, such as 20,000 g/mol to 1,000,000 g/mol, or even to 10,000,000 g/mol (e.g., higher ends of range for UHMWPE).

In some embodiments, the first polymer is polyacrylonitrile (PAN), polyvinylacetate (PVA), polyvinylpyrrolidone (PVP), a cellulose (e.g., cellulose), a polyalkylene (e.g., ultra-high molecular weight polyethylene (UHMWPE)), or the like. In certain embodiments, the second (e.g., sacrificial) polymer is a polyalkyleneoxide (e.g., PEO), polyvinylacetate (PVA), a cellulose (e.g., cellulose acetate, cellulose diacetate, cellulose triacetate, cellulose, hydroxyalkylcellulose (e.g., hydroxyethyl cellulose (e.g., HEC)), nafion, polyvinylpyrrolidone (PVP), acrylonitrile butadiene styrene (ABS), polycarbonate, a polyacrylate or polyalkylalkacrylate (e.g., polymethylmethacrylate (PMMA)), polyethylene terephthalate (PET), nylon, polyphenylene sulfide (PPS), or the like. Generally, the first and second polymers are different.

In some embodiments, a polymer provided herein comprises polyvinyl alcohol (PVA), a polyethylene oxide (PEO), polyvinylpyridine or any combination thereof. In certain embodiments, polymers provided herein comprise (e.g., as a hydrophobic or lipophilic polymer) a polyimide, a polylactic acid (PLA), a polypropylene oxide (PPO), polystyrene (PS), a nylon, a polyacrylate (e.g., poly acrylic acid, polyalkylalkacrylate—such as polymethylmethacrylate (PMMA), polyalkylacrylate, polyalkacrylate), polyacrylamide (PAA), polyvinylpyrrolidone (PVP), polyacrylonitrile (PAN), or any combination thereof. In some embodiments, a polymer provided herein comprises a thermally or chemically degradable polymer, e.g., a polyisoprene (PI), a polylactic acid (PLA), a polyvinyl alcohol (PVA), a polyethylene oxide (PEO), a polyvinylpyrrolidone (PVP), polyacrylamide (PAA) or any combination thereof. In certain embodiments, a polymer provided herien comprises thermally or chemically stable polymer, e.g., a polystyrene (PS), a poly(methyl methacrylate) (PMMA), a polyacrylonitrile (PAN), or any combination thereof. In certain embodiments, the polymer combination comprises a polymer degradable under chemical or thermal conditions, and a second polymer that is not degradable under such conditions.

In specific embodiments, the first polymer is PAN and the second polymer is CDA, CTA, nafion, or PEO. In more specific embodiments, the polymer combination is PAN and CDA or PAN and nafion. In specific embodiments, a polymer combination described herein is or comprises PI and PEO, PAN and PEO, PVA and PS, PEO and PPO, PPO and PEO, PVA and PEO, PVA and PAN, PVA and PPO, PI and PS, PEO and PS, PI and PS, PVA and PMMA, PVA and PAA, PEO and PMMA, or a combination thereof. In more specific embodiments, the polymer combination comprises PI and PS, PS and PLA, PMMA and PLA, PI and PEO, PAN and PEO, PVA and PS, PEO and PPO and PEO, or PPO and PEO.

Nanofiber Coatings

In some embodiments, a method for producing a nanostructured material (e.g., a porous nanofiber, such as an ordered porous nanofiber) described comprises coating a first nanofiber, wherein the first nanofiber comprises a polymer blend. As described in certain embodiments herein, the polymers microphase separate to create ordered structures. In some embodiments, the time required for microphase separation is reduced by annealing the first nanofiber as described herein. In some embodiments, the coating protects the first nanofiber and/or helps to maintain the morphology of the first nanofiber (e.g., size and shape of the nanofiber) under annealing conditions (e.g., increased temperature or contact with chemicals). In some embodiments, the coating allows the timescale for microphase separation of the polymer blend to match the timescale for electrospinning the first fluid stock into a first nanofiber. The coating has any suitable thickness.

The coating and/or coating agent (i.e., material that comprises the coating) comprises any suitable material. In some embodiments the coating is thermostable. In some embodiments, the coating agent comprises silica, a thermostable polymer (e.g., PS, PMMA or PAN), or any combination thereof. In some embodiments, the coating agent is dissolved in and/or combined with any other suitable material, such as in a fluid stock capable of being electrospun. In some embodiments, the coating at least partially surrounds the first nanofiber. In some embodiments, the first nanofiber is surrounded by the coating agent.

The coating is applied in any suitable manner. In some embodiments, the first nanofibers are immersed (e.g., dipped, dunked) in a coating agent. In some embodiments, the coating agent is sprayed onto the first nanofibers. In yet more embodiments, the coating agent is electrodeposited on the first nanofibers.

In some embodiments, the first fluid stock comprising the polymer combination is co-axially electrospun with a second fluid stock, wherein the second fluid stock comprises a coating agent. Methods and devices for co-axial electrospinning are described in PCT Patent Application PCT/US11/24894 filed on Feb. 15, 2011. The second fluid stock surrounds the first fluid stock in some embodiments.

Annealing of Nanofibers

In some embodiments, a method for producing an ordered porous nanofiber is described wherein the method comprises annealing a nanofiber. In some embodiments, the nanofiber comprises at least two polymer components capable of microphase separation (e.g., a polymer combination). In some embodiments, the annealing step facilitates self-assembly of the polymer combination into distinct phase elements as described herein, and/or stabilizes the distinct phase elements.

In some embodiments, the nanofiber is heated at conditions sufficient to allow the polymer combination to form or stabilize distinct phase elements. The heating is at any suitable temperature for any suitable amount of time. In some embodiments, the nanofiber is heated to a temperature of at least 40° C., at least 50° C., at least 60° C., at least 80° C., at least 100° C., at least 200° C., 50° C. to 500° C., 100° C. to 300° C., or the like. In some embodiments, the nanofiber is maintained at such an annealing temperature for at least 1 minute, at least 5 minutes, at least 20 minutes, at least 60 minutes, 1-48 hours, 2-24 hours, or the like.

Optional Removal of Nanofiber Coatings

In some embodiments, the second layer (i.e., coating) is optionally removed from the first nanofiber to produce a second nanofiber. The coating is optionally removed following annealing, wherein the second nanofiber comprises polymer combinations ordered into phase elements.

The coating is removed by any suitable method. In some embodiments, the coating is removed by heat. In some embodiments, the heat required for removing the coating is greater than the heat required for annealing the nanofiber. The heating is at any suitable temperature for any suitable amount of time. For example, the second nanofiber is heated to a temperature of about 40° C., about 50° C., about 60° C., about 80° C., about 100° C., about 200° C., and the like. In some embodiments, the second nanofiber is heated to a temperature of at least 40° C., at least 50° C., at least 60° C., at least 80° C., at least 100° C., at least 200° C., and the like. In some embodiments, the second nanofiber is maintained at an elevated temperature (i.e., heated) for about 1 minute, about 5 minutes, about 20 minutes, about 60 minutes, and the like. In some embodiments, the second nanofiber is maintained at an elevated temperature (i.e., heated) for at least 1 minute, at least 5 minutes, at least 20 minutes, at least 60 minutes, and the like.

In some embodiments, the coating is removed by ozonolysis (e.g., contacting with ozone). Ozonolysis is performed in any suitable manner for any suitable amount of time. In some embodiments, the coating is removed by treating with water (e.g., when the coating is water-soluble). In some embodiments, the coating is removed by treating with acid (e.g., hydrochloric acid, acetic acid, sulfuric acid, etc . . . ). The acid is at any suitable concentration. In some embodiments, the coating is removed by treating with a base (e.g., sodium hydroxide). In some embodiments, the coating is removed by "combined soft and hard" (CASH) chemistries.

Selective Removal of Nanofiber Materials

In one aspect, nanofibers are described wherein at least part of the nanofiber is removed, resulting in a porous nanofiber (e.g., mesoporous carbon nanofiber). In some embodiments, any nanofiber provided herein comprises the first and second polymers (e.g., with the nanofiber comprises a matrix of the first polymer and discrete domains of the second polymer). In certain embodiments, the second polymer is removed to form a mesoporous nanofiber. In certain embodiments, the second polymer is removed via selectively dissolving (e.g., with water for water soluble polymers, such as PEO, PPO, PVA, or the like; or with acetone for acetone soluble polymers, such as CDA) the second polymer. In other embodiments, the second polymer is removed during thermal carbonization of the nanofiber (e.g., wherein the first polymer is carbonized and the second (sacrificial) polymer is removed, such as by sublimation, degradation, or the like), or during a lower temperature thermal annealing of the nanofiber. Preferential solubility are determined by any suitable method, for example, treatment of a sample of bulk material of the first and second polymers can differentially be tested in a solvent for solubility thereof (e.g., measuring non-dissolved polymer after a desired time period), using published solubility tables, or the like. Similarly, suitable materials and temperatures are determined by any suitable method, such as using thermal gravimetric analysis (TGA) and/or differential scanning calorimetry (DSC) of the first and second polymers to optionally determine polymers that carbonize and/or are sacrificed at specific temperatures and conditions, using published decomposition and carbonization parameters, or the like.

In certain embodiments, thermal treatment of the nanofibers to carbonize the first polymer (and, e.g., remove the sacrificial polymer if not removed by previous processing) is achieved at any suitable temperature, such as determined according to processes described herein. In some embodiments, thermal treatment occurs at a temperature above an annealing temperature (if an annealing step takes place). In certain embodiments, thermal treatment occurs at greater than 300° C. In more specific embodiments, thermal treatment occurs at greater than 500° C. In still more specific embodiments, thermal treatment occurs at greater than 750° C. In some embodiments, thermal treatment occurs at about 500° C. to about 2000° C., e.g., about 500° C. to about 1500° C., or about 500° C. to about 1000° C., or about 800° C. to about 1200° C. In certain embodiments, the thermal treatment is conducted under inert conditions, such as under nitrogen or argon.

Figure 9:
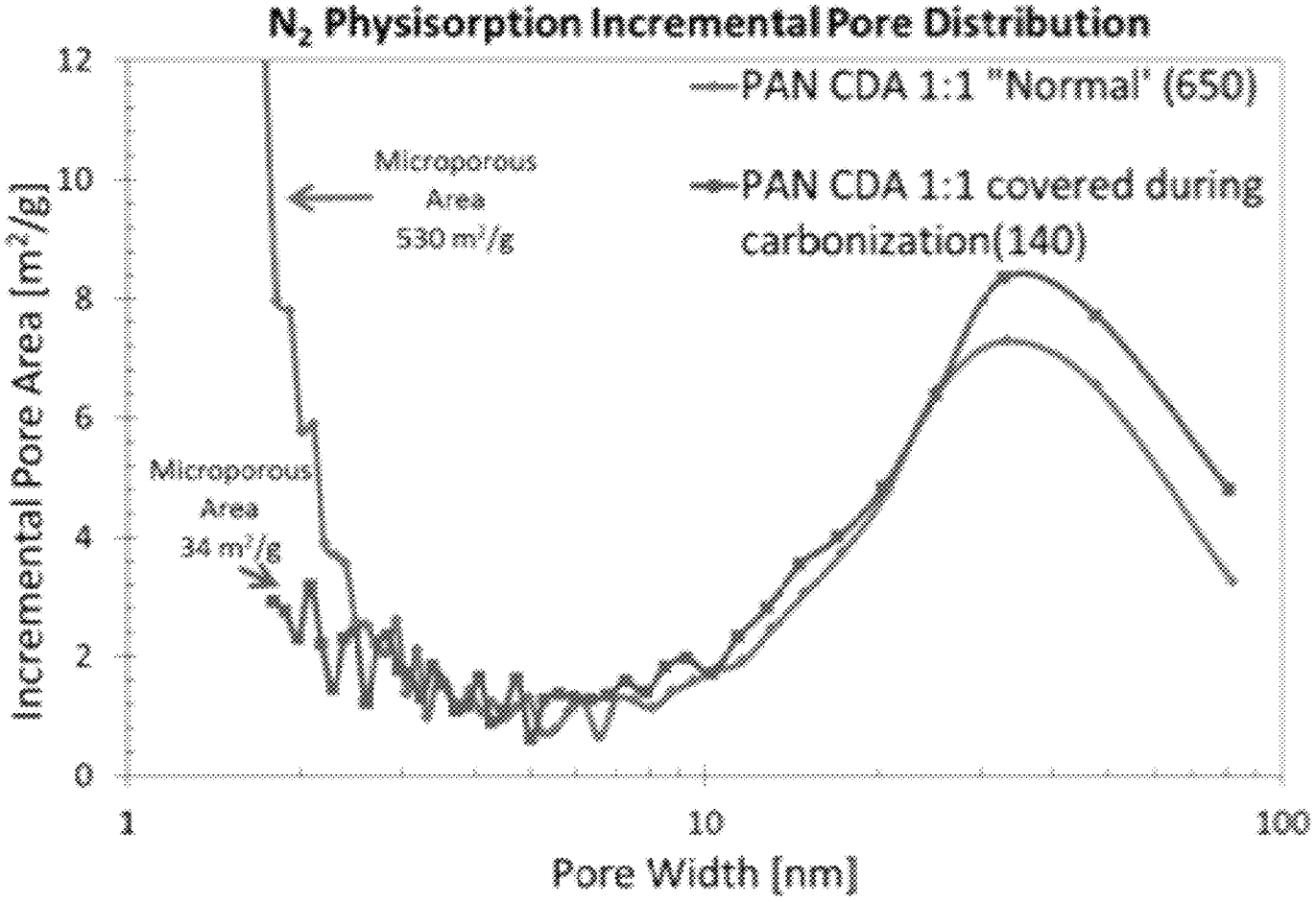
FIG. 9 illustrates the incremental pore area of mesoporous carbon nanofibers carbonized with and without compression.

In certain embodiments, the nanofiber is compressed during thermal treatment. As illustrated in FIG. 9, such compression facilitates control of the microporous domains. In certain instances, micropores are less useful to the high surface area carbon because their structures are too small for many applications. In some embodiments, compression occurs at any suitable pressure, such as at greater than 15 psi, greater than 20 psi, or the like. Compression is optional achieved by any suitable method, such as pressurized gas or mechanical force.

In some embodiments, the polymer component that is removed is at least one of the distinct phase elements. In some embodiments, the removal of at least part of the nanofiber is selective (i.e., removes the degradable and/or removable polymer, but not the polymer that does not degrade under conditions suitable for degrading and/or removing the degradable and/or removable polymer). Exemplary, but non-limiting, descriptions of such thermal conditions are as described herein.

In some embodiments, the one or more of the polymers is removed by ozonolysis (e.g., contacting with ozone). Ozonolysis is performed in any suitable manner for any suitable amount of time. In some embodiments, the polymer is removed by treating with water (e.g., when the coating is water-soluble). In some embodiments, one or more of the polymers is removed by treating with acid (e.g., hydrochloric acid, acetic acid, sulfuric acid, etc.). The acid is at any suitable concentration. In some embodiments, one or more of the polymers is removed by treating with a base (e.g., sodium hydroxide). In some embodiments, one or more of the polymers is removed by "combined soft and hard" (CASH) chemistries.

In some embodiments, one or more of the polymers is removed at the same time, or with the same conditions as are capable of removing the optional coating. In some embodiments, the optional coating is removed before removal of one or more of the polymers. In some embodiments, the optional coating is removed after removal of one or more of the polymers. In some embodiments, the conditions used to remove the optional coating are different from the conditions used to remove one or more of the polymers. In various embodiments, one or more of the polymers is removed before annealing (i.e., from the first nanofiber) or after annealing (i.e., from the second nanofiber). In various embodiments, one or more of the polymers is removed before conversion of the electrospun fluid stock to a nanofiber (i.e., calcination) or after calcination.

Exemplary Compositions, Systems and Applications of Ordered Porous Nanofibers

In one aspect, encompassed within the scope of the present invention are the ordered porous nanofibers produced by any of the methods described herein. In some embodiments, the nanofibers produced as described herein are collected (i.e., into a composition comprising a plurality of the nanofibers described herein).

In some embodiments the nanofiber composition has a high surface area. In some embodiments, ordering of the pores results in the collection of nanofibers having a high surface area and/or specific surface area (e.g., surface area per mass of nanofiber and/or surface area per volume of nanofiber). The surface area and/or specific surface area is any suitable value. In some embodiments, the collection of porous nanofibers have a specific surface area of about 10 $m^2/g$, about 50 $m^2/g$, about 100 $m^2/g$, about 200 $m^2/g$, about 500 $m^2/g$, about 1,000 $m^2/g$, about 2,000 $m^2/g$, about 5,000 $m^2/g$, about 10,000 $m^2/g$, and the like. In some embodiments, the collection of porous nanofibers have a specific surface area of at least 10 $m^2/g$, at least 50 $m^2/g$, at least 100 $m^2/g$, at least 200 $m^2/g$, at least 500 $m^2/g$, at least 1,000 $m^2/g$, at least 2,000 $m^2/g$, at least 5,000 $m^2/g$, at least 10,000 $m^2/g$, and the like.

In one aspect, described herein is a system suitable for producing ordered mesoporous nanofibers. The system comprises a fluid stock comprising a polymer combination. The system also comprises an electrospinner, a nanofiber collection module and a heater. The system optionally also comprises a second fluid stock comprising a coating agent. In some embodiments, the electrospinner is configured to be gas-assisted (e.g., as described in PCT Patent Application PCT/US11/24894 filed on Feb. 15, 2011). In some embodiments, the various components of the system interact (or are capable of interacting) to produce ordered porous nanofibers. For example, the fluid stock comprising the polymer combination (e.g., at least two polymers of a different type) and metal and/or ceramic precursor is co-axially electrospun with a second fluid stock comprising a coating agent. In this example, the productivity of the system is increased by also emanating a stream of gas with the fluid stock(s) from the electrospinner (i.e., gas assisted). The heater is capable of annealing and/or carbonizing the electrospun nanofibers.

The ordered porous nanofibers (and/or compositions including nanofibers) described herein are incorporated or capable of being incorporated into any suitable device, product, process, and the like. For example, the present invention encompasses a battery, capacitor, electrode, solar cell, catalyst, adsorber, filter, membrane, sensor, fabric, and/or tissue regeneration matrix comprising the nanofibers described herein. Also included are methods for making a battery, capacitor, electrode, solar cell, catalyst, adsorber, filter, membrane, sensor, fabric, and/or tissue regeneration matrix comprising the ordered porous nanofibers described herein.

Certain Definitions

The articles "a", "an" and "the" are non-limiting. For example, "the method" includes the broadest definition of the meaning of the phrase, which can be more than one method. In the disclosure, references to "a" material includes disclosure of a plurality of such materials. In addition, where a characteristic is referred to for "a" material, the present disclosure includes a disclosure to a plurality of such materials (e.g., nanofibers) having an average of the recited characteristic.

The term "alkyl" as used herein, alone or in combination, refers to an optionally substituted straight-chain, or optionally substituted branched-chain saturated or unsaturated hydrocarbon radical. Examples include, but are not limited to methyl, ethyl, n-propyl, isopropyl, 2-methyl-1-propyl, 2-methyl-2-propyl, 2-methyl-1-butyl, 3-methyl-1-butyl, 2-methyl-3-butyl, 2,2-dimethyl-1-propyl, 2-methyl-1-pentyl, 3-methyl-1-pentyl, 4-methyl-1-pentyl, 2-methyl-2-pentyl, 3-methyl-2-pentyl, 4-methyl-2-pentyl, 2,2-dimethyl-1-butyl, 3,3-dimethyl-1-butyl, 2-ethyl-1-butyl, n-butyl, isobutyl, sec-butyl, t-butyl, n-pentyl, isopentyl, neopentyl, tert-amyl and hexyl, and longer alkyl groups, such as heptyl, octyl and the like. Whenever it appears herein, a descriptions of an alkyl includes a description of a $C_1$-$C_6$ alkyl, and a numerical range such as "$C_1$-$C_6$ alkyl," means that: in some embodiments, the alkyl group consists of 1 carbon atom; in some embodiments, 2 carbon atoms; in some embodiments, 3 carbon atoms; in some embodiments, 4 carbon atoms; in some embodiments, 5 carbon atoms; in some embodiments, 6 carbon atoms. The present definition also covers the occurrence of the term "alkyl" where no numerical range is designated. In certain instances, "alkyl" groups described herein include linear and branched alkyl groups, saturated and unsaturated alkyl groups, and cyclic and acyclic alkyl groups.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

EXAMPLES

Example 1—Fluid Stock Preparation

The fluid stock is prepared by combining CDA (from Sigma Aldrich: Mn=50,000; degree of substitution=2.4 or 39.7 wt % acetyl) and PAN (from PolyScience, Inc.: Mw=150,000) are dissolved in dimethylformamide at a PAN:CDA weight ratio of 1:1 and a concentration of 13 wt. % polymer.

Example 2—Electrospinning

The fluid stock is electrospun (e.g., using a flow rate of 0.02 mL/min) in a center tube (20 gauge), with a concentric outer tube providing gas for gas-assisted electrospinning. A voltage (e.g., of about 10-20 kV) is applied (e.g., with a tip to collector distance of about 10-20 cm). Nanofibers comprising a combination of PAN and CDA are collected. FIG. 1 illustrates an SEM image of the collected nanofibers.

Example 3—Mesoporous Carbon Nanofibers by Direct Thermal Treatment

Figure 2:
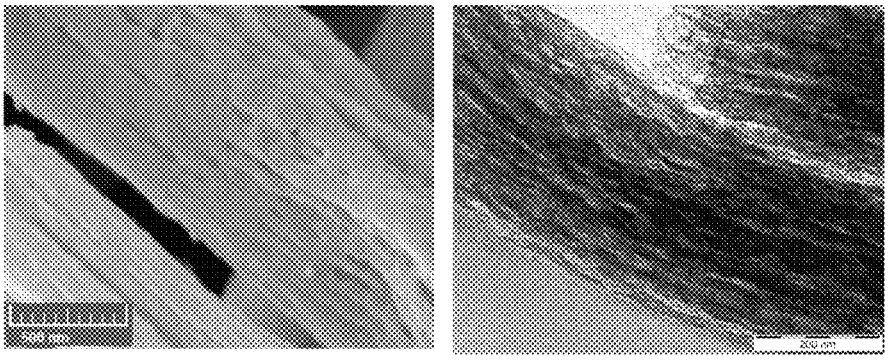
FIG. 2 (panel A) illustrates an SEM image of mesoporous carbon nanofibers and (panel B) a cross-sectional TEM image along the axis of a mesoporous carbon nanofiber, each of which were prepared by carbonizing a nanofiber comprising an exemplary polymer mixture described herein (PAN and CDA).

Nanofibers prepared according to Example 2 are collected and thermally annealed at 270 C (heated to 270 C at 1 C/min) for 0.5-3 hours and thermally carbonized at 1000 C (heated to 1000 C from 270 C at 10 C/min) under nitrogen for 15-60 minutes. The resultant carbonized nanofibers comprise a mesoporous carbon matrix. FIG. 2 (panel A) illustrates an SEM image of the carbonized nanofibers and (panel B) a cross-sectional TEM image along the axis of the nanofiber. As illustrated in the TEM image, the nanofiber comprises a highly porous internal structure.

Example 4—Mesoporous Nanofibers by Selective Dissolution

Figure 3:
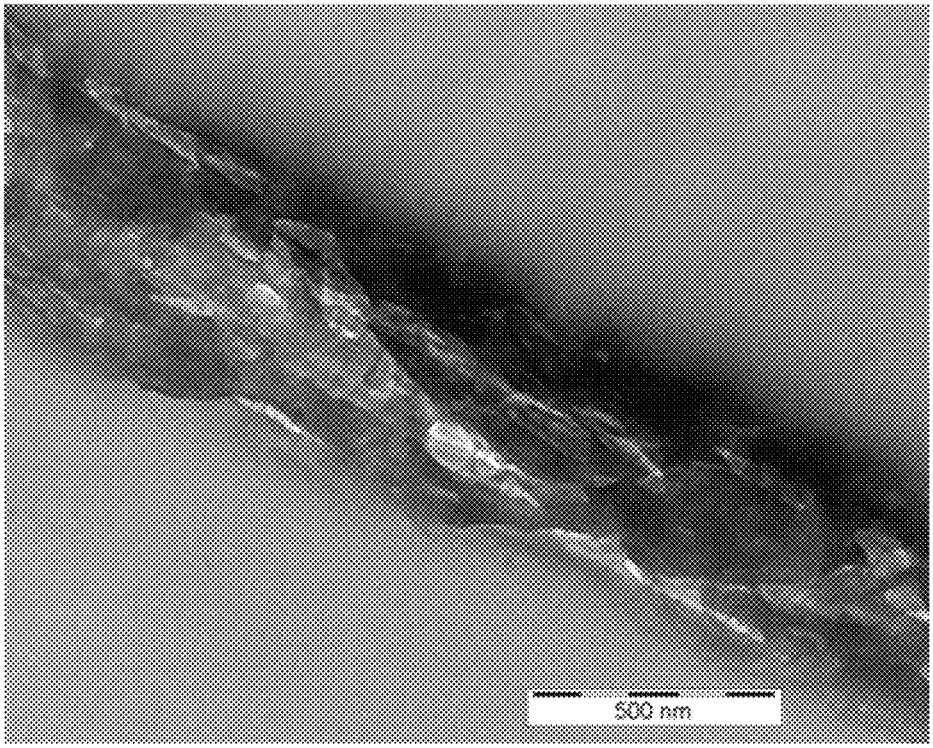
FIG. 3 illustrates a cross-sectional TEM image along the axis of a mesoporous polymer nanofiber, the nanofiber being prepared by preparing a nanofiber comprising an exemplary polymer mixture and subsequently selectively dissolving the second polymer (CDA), leaving a mesoporous polymer of the first polymer (PAN).

Nanofibers prepared according to Example 2 are collected and washed with acetone. The second polymer component (CDA) is selectively dissolved to afford a mesoporous PAN nanofiber. FIG. 3 illustrates a cross-sectional TEM image along the axis of the nanofiber. As illustrated by the TEM image, the nanofiber comprises a highly porous structure.

Figure 5:
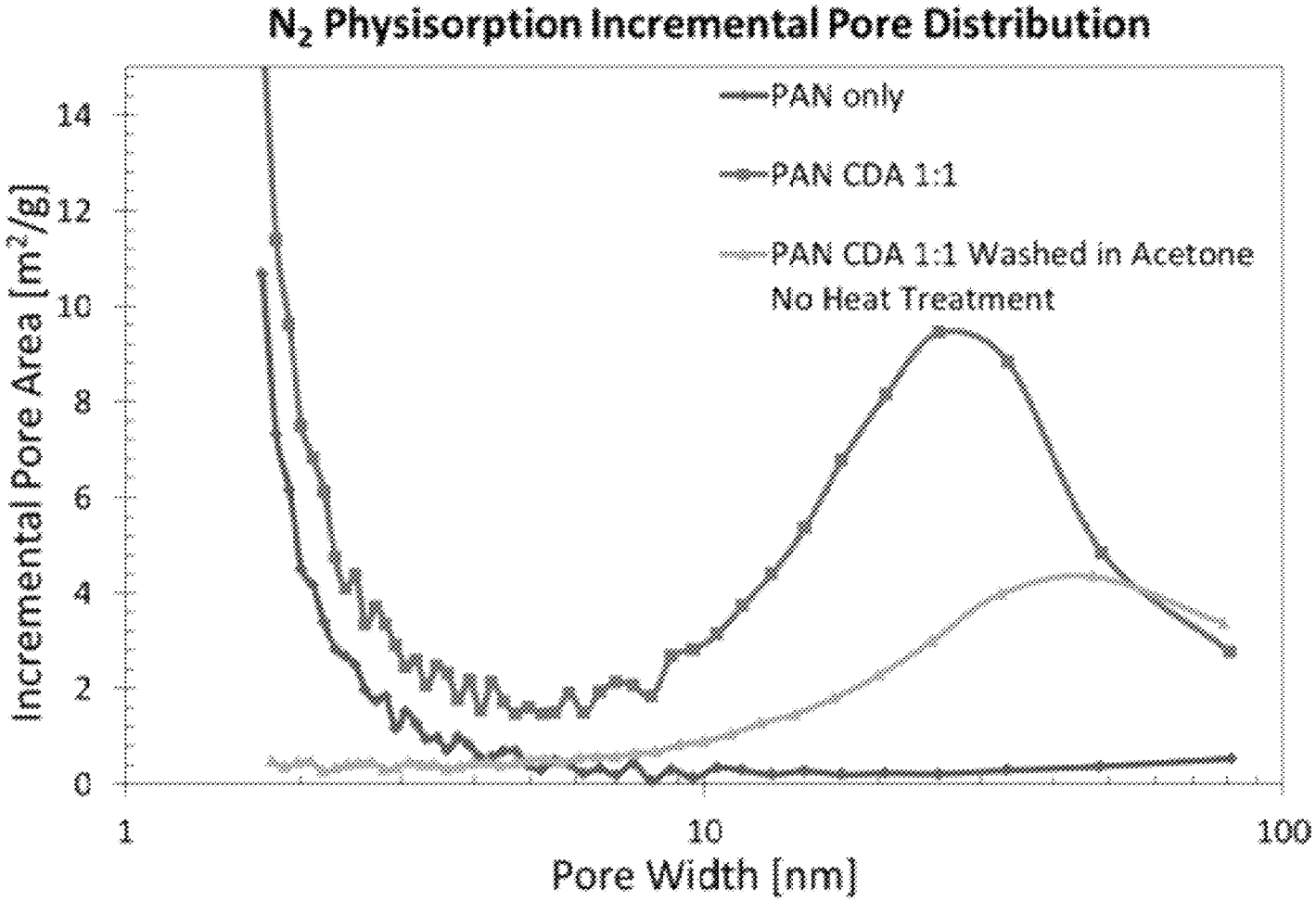
FIG. 5 illustrates the pore distribution of mesoporous carbon nanofibers prepared according to an exemplary process herein and the pore distribution of mesoporous polymer nanofibers prepared by selective dissolution and removal of one polymer component from a two-polymer component nanofiber, as well as the pore distribution of non-mesoporous carbon nanofibers prepared using a single polymer, for comparative results.

FIG. 5 illustrates the pore distribution (measured using BJH method) of the carbonized nanofibers prepared according to Example 3, compared to the pore distribution of the selectively dissolved porous polymer nanofibers of this Example 4, and carbonized PAN nanofibers prepared according to these examples (without the presence of a second polymer). The mesoporous nature of these nanofibers prepared according to both Examples 3 and 4 are evident.

The selectively dissolved porous PAN nanofibers of this Example 4 are then carbonized utilizing a process as described in Example 3.

Example 5—Concentration Variation of Polymer Components

Figure 6:
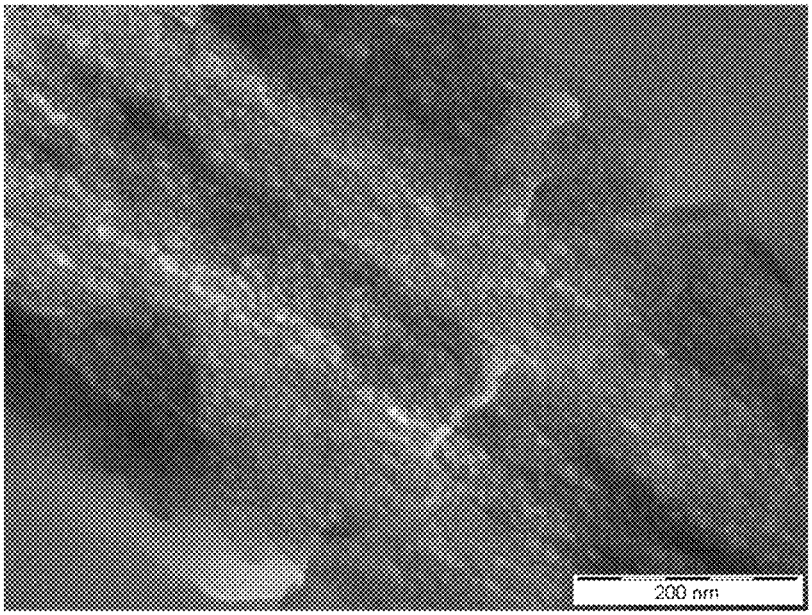
FIG. 6 illustrates cross-sectional TEM image along the axis of mesoporous carbon nanofibers prepared from fluid stocks and two-component polymer nanofibers having various exemplary polymer ratios.
Figure 6:
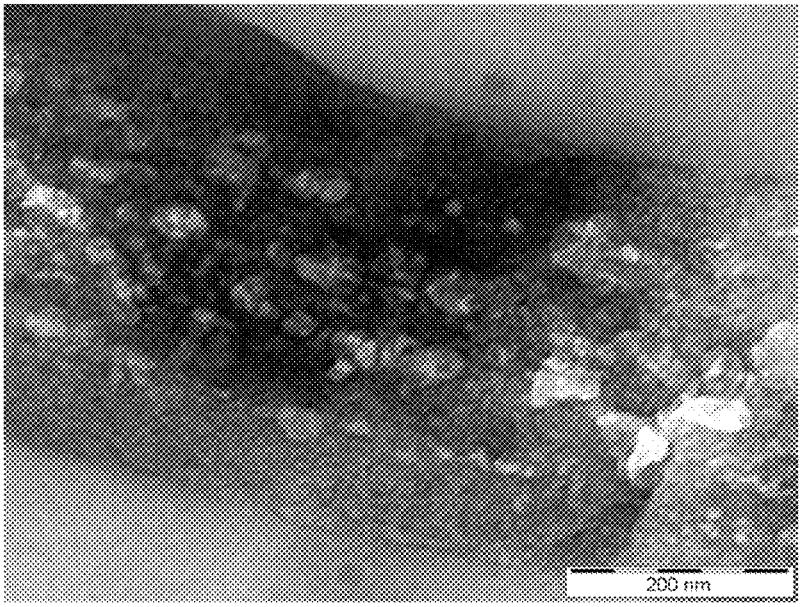
Figure 7:
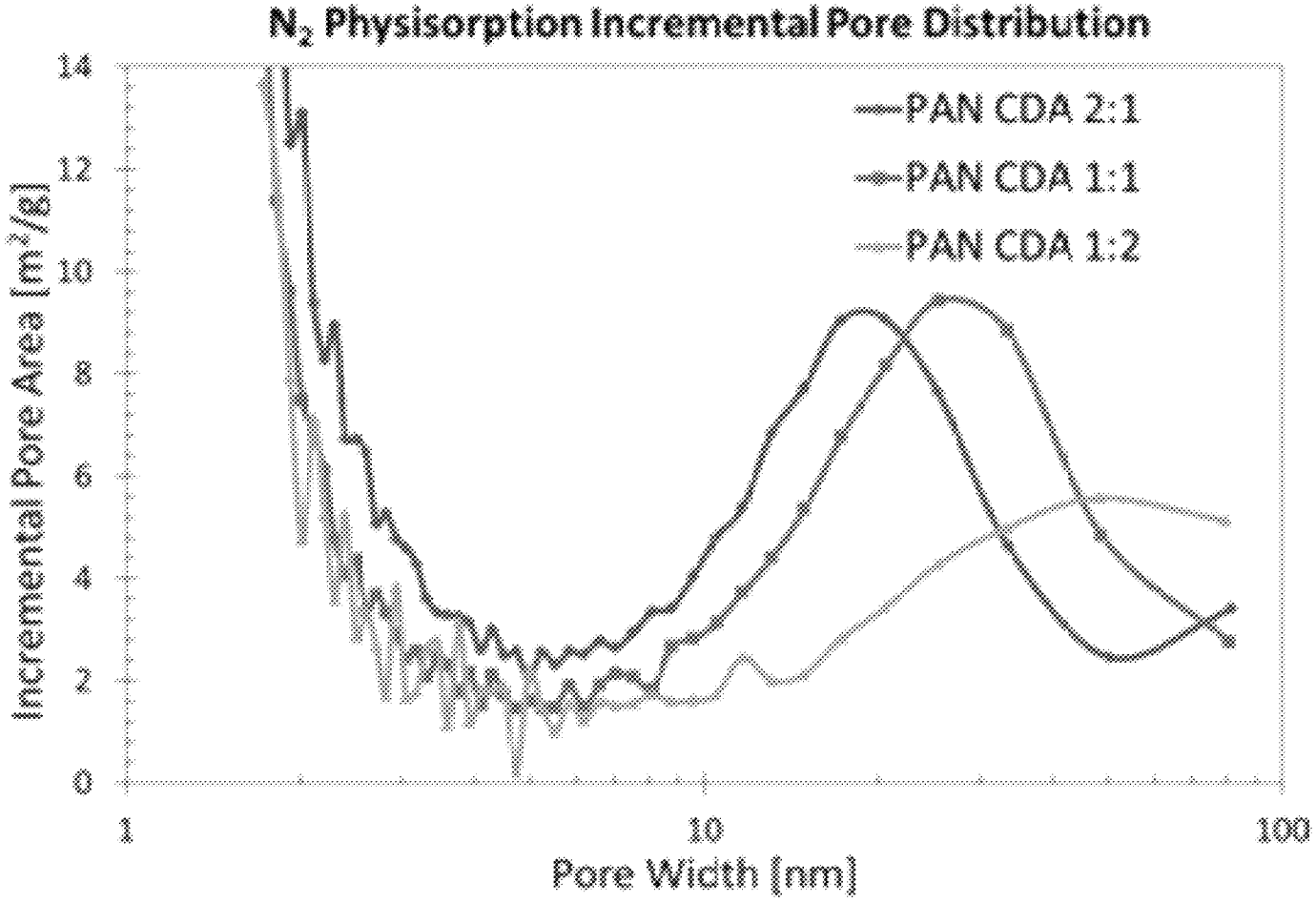
FIG. 7 illustrates that the average pore width and the pore distribution of mesoporous carbon nanofibers prepared from fluid stocks and two-component polymer nanofibers having various exemplary polymer ratios.

Fluid stocks are prepared according to Example 1, with PAN to CDA weight ratios of 2:1 and 1:2. The stocks are then electrospun according to Example 2 and carbonized according to Example 3. FIG. 6 (panel A) illustrates a cross-sectional TEM image along the axis of the mesoporous carbon nanofiber prepared using a PAN:CDA weight ratio of 2:1 and (panel B) a cross-sectional TEM image along the axis of the mesoporous carbon nanofiber prepared using a PAN:CDA weight ratio of 1:2. FIG. 7 illustrates that the average pore width and the pore distribution of the carbonized nanofibers increases with increased concentrations of sacrificial polymer (CDA).

Example 6—Compression During Carbonization

Fluid stocks are prepared according to Example 1, with PAN to CDA weight ratios of 1:1. The stocks are then electrospun according to Example 2 and carbonized similar to as set forth in Example 3, with the addition of pressure/compression applied to the nanofibers during carbonization. FIG. 9 that the incremental pore area decreases from 650 $m^2/g$ to 140 $m^2/g$ with compression, but that the decrease is due primarily due to the reduction in micropore area. As can be seen, the incremental pore area of the mesopores remains about the same.

Example 7—Polymer Variation

A variety of fluid stocks are prepared similar to Example 1, using a number of sacrificial polymers in the place of CDA. Electrospinning and carbonization according to Examples 2 and 3 of polymer combinations was also conducted by separately substituting the sacrificial polymer of Example 1 (CDA) with PEO, PVA, cellulose triacetate, cellulose, nafion, PVP, m-aramid, and SAN. Other sacrificial polymers include, by way of non-limiting example, polycarbonate, PMMA, PET, nylon, and PPS. Similarly, the first (carbonizing) polymer of Example 1 is substituted with m-aramid, PVA, PVP, cellulose, or UHMWPE in various examples.

Figure 10:
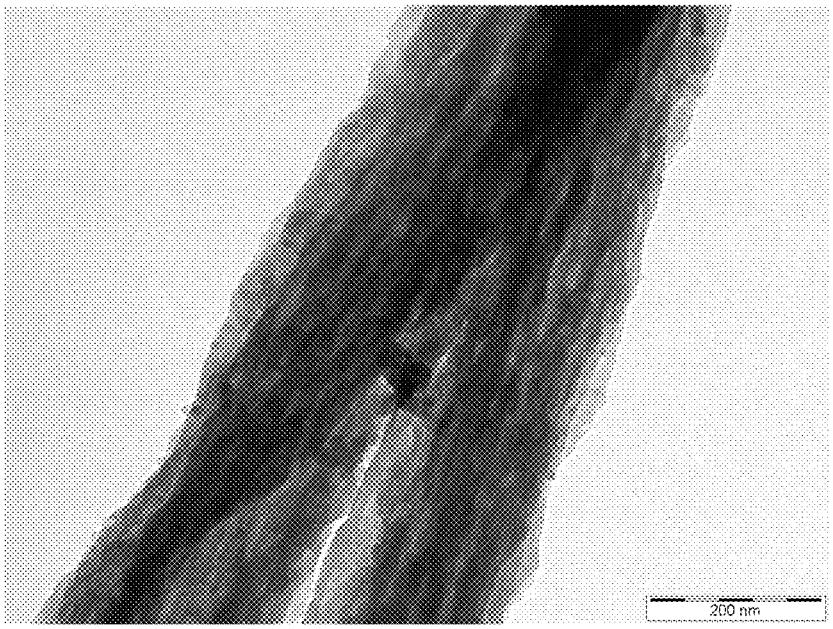
FIG. 10 illustrates a TEM image of an exemplary porous polymer nanofiber from the combination of PAN and PEO, following the sacrifice of PEO.
Figure 11:
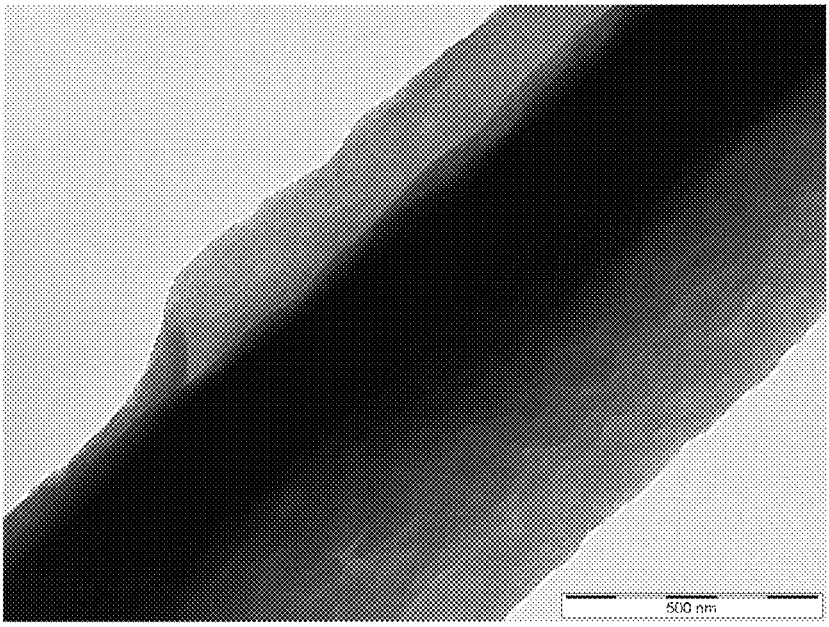
FIG. 11 illustrates a TEM image of an exemplary porous nanofiber from the combination of PAN and PEO, following the sacrifice of PEO and subsequent carbonization.
Figure 12:
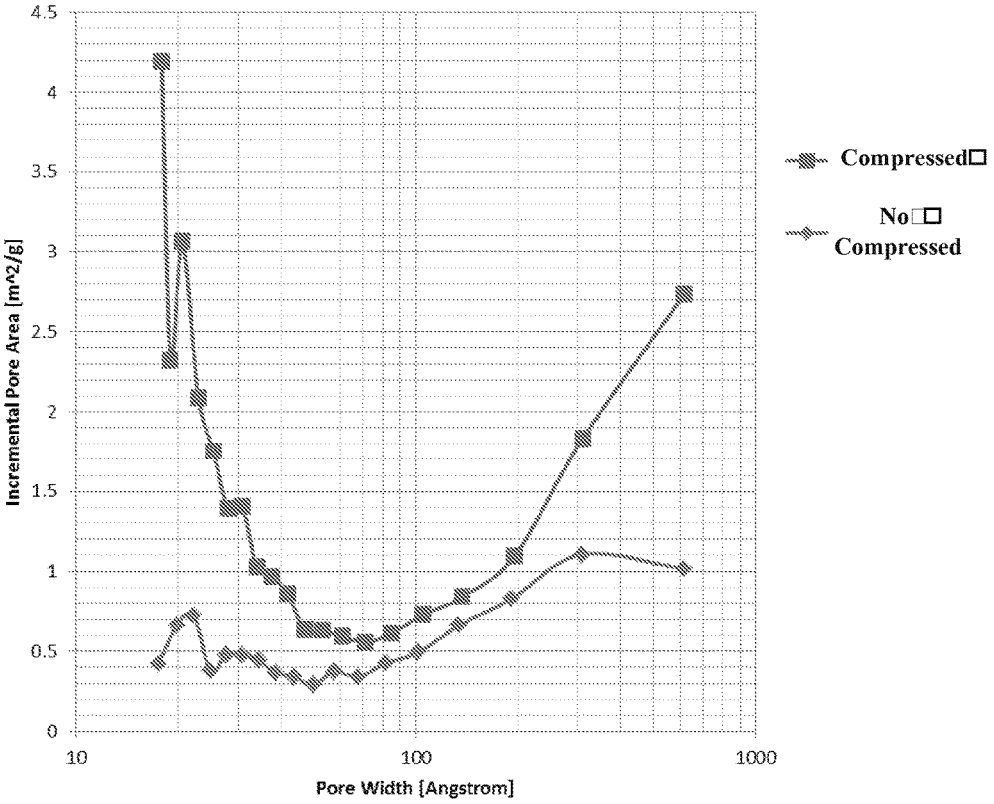
FIG. 12 illustrates the pore distribution of carbonized nanofibers prepared from exemplary polymer combinations provided herein (PAN/PEO).

For example, FIG. 10 illustrates a TEM image of a mesoporous polymer nanofiber prepared by combining and electrospinning PAN as a first polymer and PEO (used interchangeably herein with polyethylene glycol) as a second (sacrificial) polymer (electrospun from a 13 wt % polymer stock; PAN:PEO in a 1:1 wt ratio), followed by a water wash. FIG. 11 illustrates a TEM image of such a polymer following carbonization. FIG. 12 illustrates the pore distribution of the carbonized nanofibers prepared from such PAN:PEO combinations using compression and no-compression techniques during carbonization (after stabilization, and no washing). The mesoporous nature of these nanofibers are evident, with the nanofibers carbonized while compressed demonstrating increased concentration of pores in the 3-100 nm diameter range.

Figure 13:
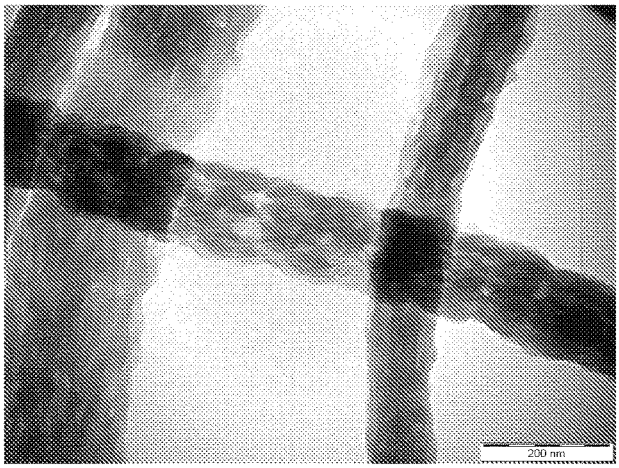
FIG. 13 illustrates a TEM image of an exemplary porous nanofiber from the combination of PAN and nafion, following the sacrifice of nafion.

FIG. 13 illustrates a TEM image of a porous nanofiber prepared by combining and electrospinning PAN and nafion (electrospun from a 10 wt % polymer stock; PAN:nafion in a 3:2 wt ratio) and washed with a water/ethanol mixture.

Example 8—Fibers Versus Films

Figure 14:
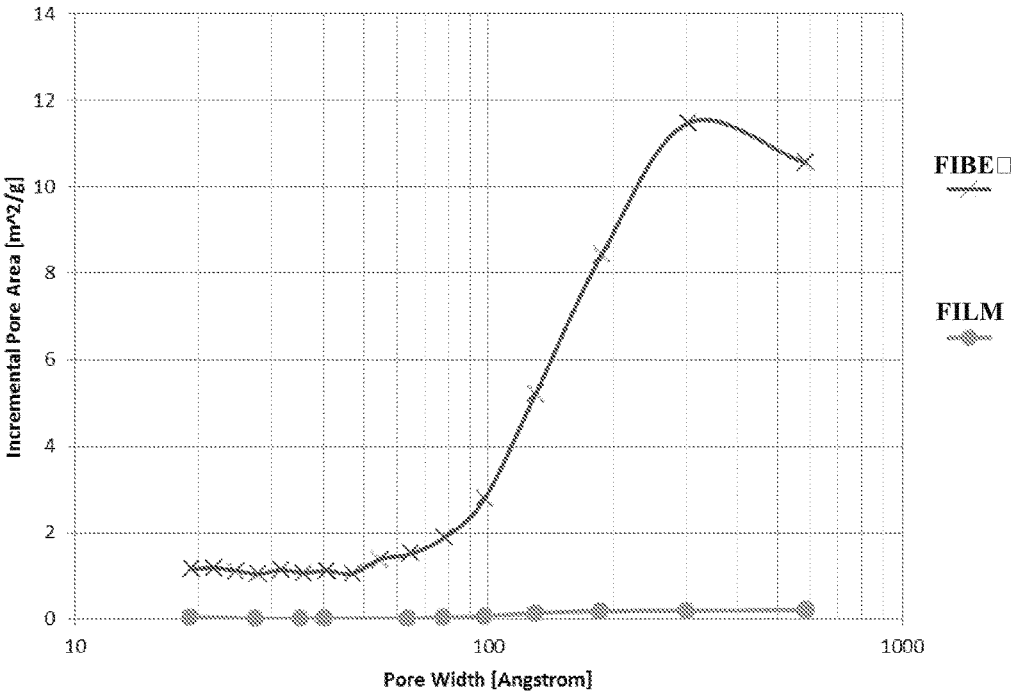
FIG. 14 illustrates the pore distribution of nanofibers and films prepared from exemplary polymer combinations provided herein (PAN/PEO), following sacrifice of PEO via dissolution.

For comparison, polymer blends used herein were formed into films. For example, PAN/PEO combinations (10 polymer wt % in fluid stock; 1:1 wt ratio) as described in Example 7 were solution cast and electrospun, followed by washing with water (at 95 C). The resulting nanofibers demonstrated high concentrations of pores in the 3-100 nm range, whereas the films did not, as illustrated by FIG. 14.

What is claimed is:

1. A process for producing a mesoporous carbon nanofiber, the process comprising:

a. electrospinning a fluid stock to produce a nanofiber, the fluid stock comprising a first polymer component and a second polymer component, the electrospinning of the fluid stock being gas-assisted; and b. thermally treating the nanofiber to carbonize the first polymer component and remove the second polymer component, thereby producing a mesoporous carbon nanofiber having an average mesopore size between 5 nm and 50 nm, wherein mesopores have a diameter of 2 nm to 50 nm and wherein the pore area of the mesopores is about 50 $m^2/g$ to about 200 $m^2/g$.

2. The process of claim 1, wherein the mesoporous carbon nanofiber has an average mesopore size of between 20 nm and 50 nm.

3. The process of claim 1, wherein the weight ratio of first polymer to second polymer present in the fluid stock is 10:1 to 1:10.

4. The process of claim 3, wherein the weight ratio of first polymer to second polymer present in the fluid stock is 10:1 to 1:4.

5. The process of claim 1, wherein thermally treating the nanofiber comprises thermally treating the nanofiber at a temperature of at least 500° C.

6. The process of claim 1, wherein thermally treating the nanofiber comprises a first thermal treatment at a temperature between 50° C. and 500° C. for at least 20 minutes and a second thermal treatment at a temperature of at least 500° C. for at least 20 minutes.

7. The process of claim 1, wherein the first polymer comprises a polyacrylonitrile (PAN), polyvinylacetate (PVA), polyvinylpyrrolidone (PVP), cellulose, or ultra-high molecular weight polyethylene (UHMWPE).

8. The process of claim 1, wherein the second polymer comprises a polyethylene oxide (PEO), polyvinylacetate (PVA), cellulose acetate, cellulose diacetate (CDA), cellulose triacetate, cellulose, nafion, polyvinylpyrrolidone (PVP), acrylonitrile butadiene styrene (ABS), polycarbonate, polymethylmethacrylate (PMMA), polyethylene terephthalate (PET), nylon, or polyphenylene sulfide (PPS).

9. The process of claim 1, wherein the first and second polymer components comprise polyacrylonitrile (PAN) and polyethylene oxide (PEO), polyacrylonitrile (PAN) and cellulose diacetate (CDA), polyacrylonitrile (PAN) and polyvinyl alcohol (PVA), polyacrylonitrile (PAN) and polymethylmethacrylate (PMMA), or polyacrylonitrile (PAN) and polyvinylpyrrolidone (PVP).

10. The process of claim 1, wherein electrospinning is co-axially gas-assisted.

11. The process of claim 1, further comprising compressing the nanofiber during the thermal treatment.

12. The process of claim 1, wherein the pore area of micropores of the mesoporous carbon nanofiber is less than 100 $m^2/g$.

13. A mesoporous carbon nanofiber having a mesoporous pore area of at least 50 $m^2/g$ and an average mesoporous pore size between 5 nm and 50 nm, wherein mesopores have a diameter of between 2 nm and 50 nm.

14. The mesoporous carbon nanofiber of claim 13, wherein the average mesoporous pore size is between 20 nm and 50 nm.

15. The mesoporous carbon nanofiber of claim 14, wherein the mesoporous carbon nanofiber has a microporous area of less than 100 $m^2/g$.

16. The mesoporous carbon nanofiber of claim 14, having a pore area of at least 250 $m^2/g$.

* * * * *